US010405625B2

(12) United States Patent
Cardenas

(10) Patent No.: US 10,405,625 B2
(45) Date of Patent: Sep. 10, 2019

(54) BRA STORAGE APPARATUS

(71) Applicant: Elsa Cardenas, Grand Terrace, CA (US)

(72) Inventor: Elsa Cardenas, Grand Terrace, CA (US)

( * ) Notice: Subject to any disclaimer, the term of this patent is extended or adjusted under 35 U.S.C. 154(b) by 14 days.

(21) Appl. No.: 15/913,902

(22) Filed: Mar. 6, 2018

(65) Prior Publication Data

US 2018/0255892 A1 Sep. 13, 2018

Related U.S. Application Data

(60) Provisional application No. 62/468,313, filed on Mar. 7, 2017.

(51) Int. Cl.

| | |
|---|---|
| ***A45C 9/00*** | (2006.01) |
| ***A45C 13/03*** | (2006.01) |
| ***A47G 25/30*** | (2006.01) |
| ***A45C 11/00*** | (2006.01) |
| ***A45C 13/00*** | (2006.01) |
| ***D06F 59/02*** | (2006.01) |
| ***A47B 61/00*** | (2006.01) |
| ***A47B 61/06*** | (2006.01) |
| *A41C 3/00* | (2006.01) |
| *A47G 25/14* | (2006.01) |

(52) U.S. Cl.

CPC ..... *A45C 13/03* (2013.01); *A45C 11/00* (2013.01); *A45C 13/00* (2013.01); *A47B 61/003* (2013.01); *A47B 61/06* (2013.01); *A47G 25/30* (2013.01); *D06F 59/02* (2013.01); *A41C 3/00* (2013.01); *A47G 2025/1492* (2013.01)

(58) Field of Classification Search

CPC ..... A45C 13/03; A45C 11/00; A45C 13/00

USPC ..... 206/278, 279, 280, 282, 289, 291, 290; 190/8, 13 R, 18 A; 34/202, 220, 289, 34/622; 312/6, 3, 321.5, 292, 242

See application file for complete search history.

(56) References Cited

U.S. PATENT DOCUMENTS

| | | | | | |
|---|---|---|---|---|---|
| 1,913,021 | A * | 6/1933 | Butterick | A45C 13/03 | 190/36 |
| 3,139,978 | A * | 7/1964 | Moglia | B65D 85/185 | 206/291 |
| 4,738,340 | A * | 4/1988 | Crespi | A45C 5/00 | 190/109 |
| 5,175,944 | A * | 1/1993 | Fruehauf | D06F 59/02 | 34/60 |
| 8,726,534 | B2 * | 5/2014 | Chappell | F26B 9/003 | 206/315.1 |
| 10,123,597 | B1 * | 11/2018 | Tong | A45C 5/03 | |
| 2008/0296110 | A1 * | 12/2008 | Simester | A45C 7/0063 | 190/14 |

FOREIGN PATENT DOCUMENTS

| | | | | |
|---|---|---|---|---|
| CN | 201217757 Y | * | 4/2009 | |
| CN | 203429460 U | * | 2/2014 | |
| CN | 208517687 U | * | 2/2019 | |
| GB | 2394271 A | * | 4/2004 | D06F 58/10 |

* cited by examiner

*Primary Examiner* — Fenn C Mathew
*Assistant Examiner* — Cynthia F Collado
(74) *Attorney, Agent, or Firm* — Bruce A. Lev

(57) ABSTRACT

A bra storage apparatus for the storage, transport, and air-drying of brassieres structured and arranged to be compact, lightweight, and designed to hold six to eight bras in a locking system that will maintain their shape thereby appealing strongly to any woman, both for home-use and use when traveling.

16 Claims, 4 Drawing Sheets

BRA STORAGE APPARATUS

CROSS-REFERENCE TO RELATED APPLICATION

The present application is related to and claims priority from prior provisional application Ser. No. 62/468,313, filed Mar. 7, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of bra storage systems and more specifically relates to a bra storage apparatus for the storage, transport, and air-drying of brassieres structured and arranged to be compact, lightweight, and designed to hold six to eight bras in a locking system that will maintain their shape thereby appealing strongly to any woman, both for home-use and use when traveling.

2. Description of the Related Art

A bra is a form-fitting undergarment designed to support or cover the wearer's breasts. Swimsuits, camisoles and backless dresses may have built-in breast support. Bras are complex garments made of many parts. Most come in 36 sizes; standards and methods of measurement vary widely. Up to 85% of women may be wearing the wrong size. The bra's main components are a chest band that wraps around the torso, two cups, and shoulder straps. The chest band is usually closed in the back by a hook and eye fastener, but may be fastened at the front. Sleep bras or athletic bras do not have fasteners and are pulled on over the head and breasts. The section between the cups is called a gore. The section under the armpit where the band joins the cups is called the "back wing".

Bra components, including the cup top and bottom (if seamed), the central, side and back panels, and straps, are cut to manufacturer's specifications. Many layers of fabric may be cut at the same time using computer-controlled lasers or bandsaw shearing devices. The pieces are assembled by piece workers using industrial sewing machines or automated machines. Coated metal hooks and eyes are sewn in by machine and heat processed or ironed into the back ends of the band and a tag or label is attached or printed onto the bra itself. The completed bras are folded (mechanically or manually), and packaged for shipment.

The chest band and cups, not the shoulder straps, are designed to support the weight of women's breasts. Strapless bras rely on an underwire and additional seaming and stiffening panels to support them. The shoulder straps of some sports bras cross over at the back to take the pressure off the shoulders when arms are raised. Manufacturers continually experiment with proprietary frame designs.

Consider, for example, two simple facts. First, there are approximately 125 million females age 15 and older in the United States population. Second, the lingerie market in the United States amounts to nearly $13 billion per year. That's a lot of bras and panties; and when it comes to bras, most women have a selection—perhaps six or eight—to wear, wash, air-dry, and store. What they don't have, however, is a simple, convenient, and portable means of doing all this—so they wind up with wet bras slung over the shower-curtain rod, or hung on hangers from which the straps slide off; and they keep their bras in drawers where they lose their shape. Bras can be expensive, and every woman knows the frustration of seeing one, or more, ruined in this way.

Various attempts have been made to solve problems found in bra storage systems art. Among these are found in: U.S. Pat. No. 7,516,840 to Troha et al.; U.S. Pat. No. 8,499,930 to Cara Parness; and U.S. Pat. No. 8,985,348 to Frances Prado. This prior art is representative of bra storage systems.

Ideally, a bra storage apparatus should be user-friendly and safe in-use and yet should operate reliably and be manufactured at a modest expense. Thus, a need exists for a bra storage apparatus for the storage, transport, and air-drying of brassieres structured and arranged to be compact, lightweight, and designed to hold six to eight bras in a locking system that will maintain their shape thereby appealing strongly to any woman, both for home-use and use when traveling and to avoid the above-mentioned problems.

BRIEF SUMMARY OF THE INVENTION

In view of the foregoing disadvantages inherent in the known bra storage systems art, the present invention provides a Bra Storage Apparatus. The general purpose of the present invention, which will be described subsequently in greater detail is to provide a bra storage apparatus for the storage, transport, and air-drying of brassieres structured and arranged to be compact, lightweight, and designed to hold six to eight bras in a locking system that will maintain their shape thereby appealing strongly to any woman, both for home-use and use when traveling.

A bra storage apparatus comprising: a casing; a plurality of hanger members; a water tray member; and a collection cup member. The casing including: a back panel; a pair of front door members; a top panel; a bottom panel and pair of side panel members. The back panel includes a plurality of retainer members attached to an inner surface thereof in a spaced linear configuration, wherein each are adapted to releasably retain an end of a hanger member therein. The pair of front door members, each include a plurality of retainer members attached to an inner surface thereof in a spaced linear configuration, wherein each are adapted to releasably retain an end of a hanger member therein. Wherein the top panel is attached to a top potion of said back panel and extends towards said pair of front door members. Wherein said bottom panel is attached to a bottom potion of said back panel and extends towards said pair of front door members.

Wherein the pair of side panel members are attached to respective side portions of said back panel and extend towards said pair of front door members. Wherein each of the pair of front door members are pivotally attached to a respective side panel member. Wherein the top panel, the bottom panel, said pair of side panel members, and the pair of front door members form an interior volume. Wherein the pair of side panel members further comprises a hanger rail is connected between respective inside surfaces of said pair of side panel members, and is adapted to movably retain a plurality of hanger members thereon.

Wherein each of the plurality of hanger members are adapted to be movably retained upon the hanger rail. Wherein each of the plurality of hanger members include opposite ends that are adapted to be releasably retained by respective the plurality of retainer members of the back panel and the pair of front door members, such that when the pair of front door members are in a closed position each of the plurality of hanger members are held in place between the back panel and the pair of front door members via respective the plurality of retainer members of the back panel and the pair of front door members, and when the pair of front door members are moved into an open position each of the plurality of hanger members can be released form the respective said plurality of retainer members and used to retain a bra thereon or release a bra therefrom.

Wherein the water tray member is adapted to be removably placed within the interior volume at an angle to the bottom panel and is adapted to allow water dripping from wet bras hanging from the plurality of hanger members to contact a surface thereof and flow down downwardly upon the surface and outwardly from the interior volume.

Wherein the collection cup member is adapted to be placed in proximity to an edge portion of water tray member when the water tray member is being used to direct water outwardly from the interior volume and is adapted to collect the water therein.

The present invention holds significant improvements and serves as a Bra Storage Apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Bra Storage Apparatus, constructed and operative according to the teachings of the present invention.

The various embodiments of the present invention will hereinafter be described in conjunction with the appended drawings, wherein like designations denote like elements.

DETAILED DESCRIPTION

Figure 1:
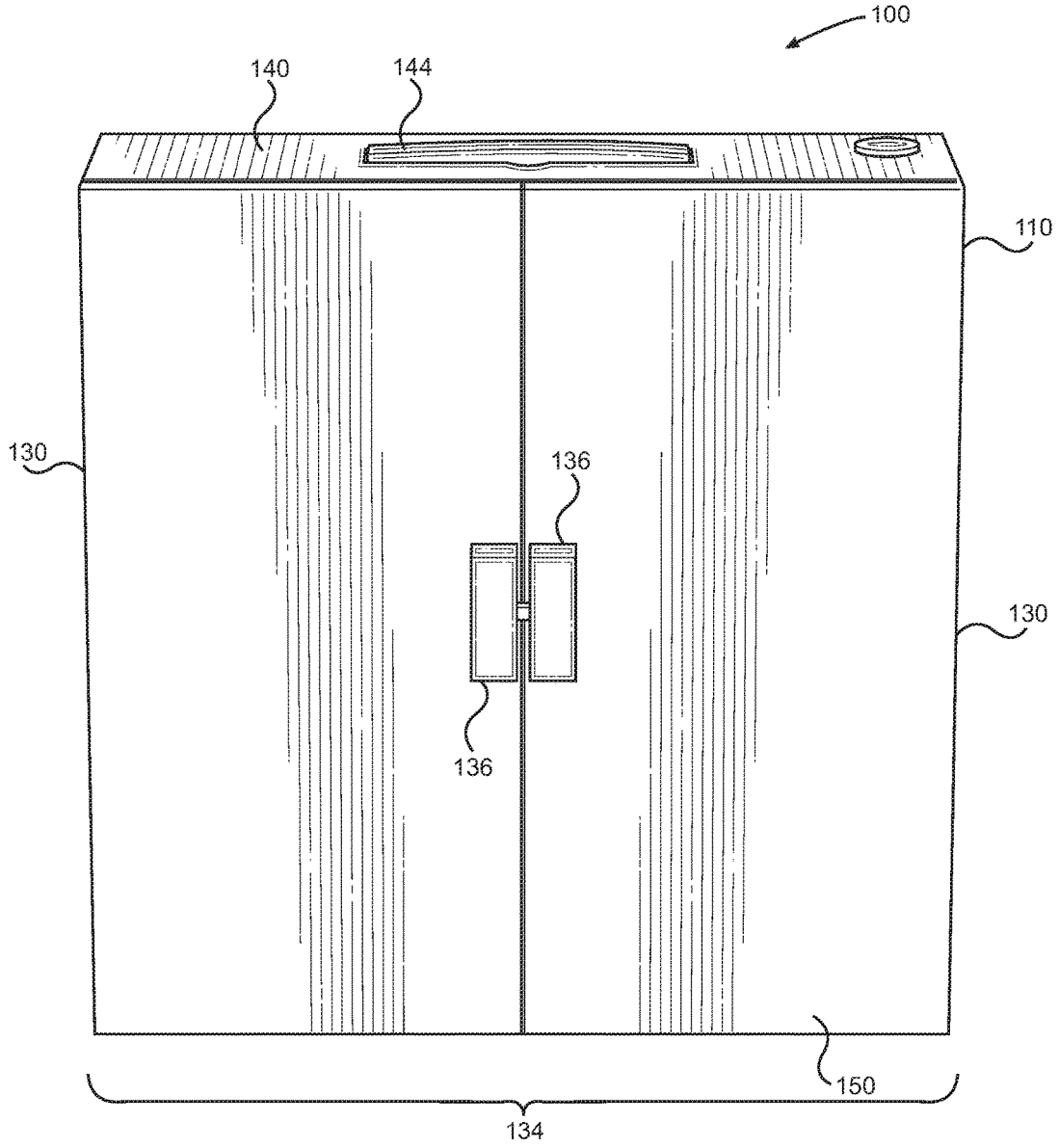
FIG. 1 shows a perspective view illustrating a Bra Storage Apparatus in a closed position according to an embodiment of the present invention.

As discussed above, embodiments of the present invention relate to a bra storage system and more specifically relates to a bra storage apparatus for the storage, transport, and air-drying of brassieres structured and arranged to be compact, lightweight, and designed to hold six to eight bras in a locking system that will maintain their shape thereby appealing strongly to any woman, both for home-use and use when traveling.

Generally speaking, the Bra Storage Apparatus comprises a specially designed multi-function, personal case for six to eight bras—a case designed for storing bras in a safe and shapely manner; for air-drying bras; and for transporting bras in traveling.

The Bra Storage Apparatus would consist of a lightweight yet sturdy and durable, molded-plastic case, measuring 38 to 40 inches in length and width and 12 to 13 inches in depth, with a collapsing or "hidden" handle at the top, and a pair of locking front panels that, when opened, swing out to either side of the case. In the rear of the case would be two back panels where the drip tray or water tray is stored. The water tray would be pulled down and out in front of the case (like a roll top desk) to collect any dripping water when bras are hung in the case to dry. This tray will channel or drain the dripping water into the lower right corner of the panel. A removable collection cup could be situated in this corner for simple water removal. Inside, the bras will be hung on special hangers with shoulder slots or grooves to hold the bra straps securely.

Rather than hanging by a hook, the hangers will feature a ball top system which allows the hanger to slide along the railing which runs the length of the case, thus preventing the hangers from falling off. On the back panel, there would also be slots for one of the side ends of each of the hangers. Each hanger would also have one designated slot on the inside of either front door. When one end of the hanger is in the back-panel slot, it will line up the other end of the hanger within its designated slot. In this manner, when the doors close, each hanger will be fully secured in place, and will not budge, move, or fall off the rail, even if the case is dropped or tossed around during traveling. This will also guarantee that the bras will remain in place on the hangers. The Bra Storage System will accommodate six to eight bras via this hanger-rail.

The Bra Storage Apparatus would keep bras in the best shape possible and thus prolong the life of the bra. The Bra Storage Apparatus could be hung on a wall, mounted atop any flat surface, or easily transported in a worry-free manner, thus presenting women with a compact, convenient, and multi-functional case expressly designed for the safe and shapely storage, air-drying, and transport of multiple bras. In addition, this product would alleviate the embarrassing situation of having a house-guest enter your bathroom, when bras are left to hang dry from the shower curtain-rod! (Not to mention the eminent slipping hazard!) Further, the Bra Storage Apparatus—as opposed to a dresser drawer—would keep bras shapely rather than crushing and bending them. Sturdy, durable, and locking, the Bra Storage System would keep bras secure, beautifully intact, and in place.

Referring now to FIGS. 1-4, showing perspective views illustrating bra storage apparatus 100 according to an embodiment of the present invention of FIG. 1

Bra storage apparatus 100 comprising: casing 110; plurality of hanger members 400; water tray member 300; and collection cup member 270. Casing 110 including: back panel 200; pair of front door members 130; top panel 140; bottom panel 150 and pair of side panel members 230. Wherein top panel 140, bottom panel 150, pair of side panel members 230, and pair of front door members 130 are formed from molded plastic.

Pair of front door members 130, each include plurality of retainer members 250 attached to an inner surface thereof in a spaced linear configuration, wherein each are adapted to releasably retain an end of hanger member 400 therein. Wherein plurality of retainer members 250 are each formed including a pair of spaced, elongated, flexible retention members 260 adapted such that when an end of hanger member 400 is pushed between a pair of spaced, elongated, flexible retention members 260 said end of hanger member 400 is releasably frictionally held therebetween. Wherein pair of front door members 130 are adapted to be releasably locked in a closed position 134 as shown in FIG. 1. Wherein each of pair of front door members 130 has handle member 136 attached to an outer surface thereof.

Figure 2:
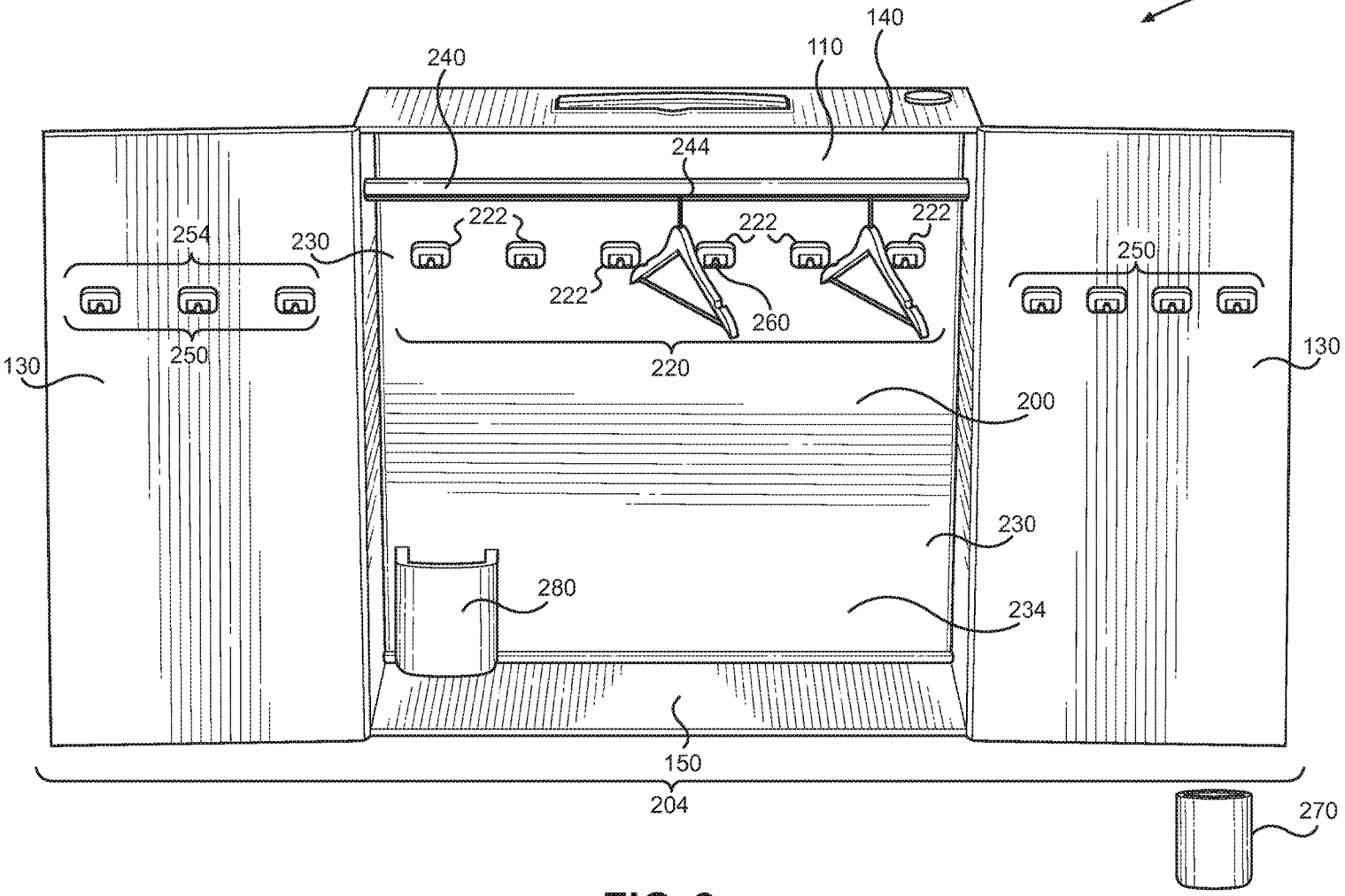
FIG. 2 shows a perspective view illustrating the Bra Storage Apparatus in an open position according to an embodiment of the present invention.
Figure 3:
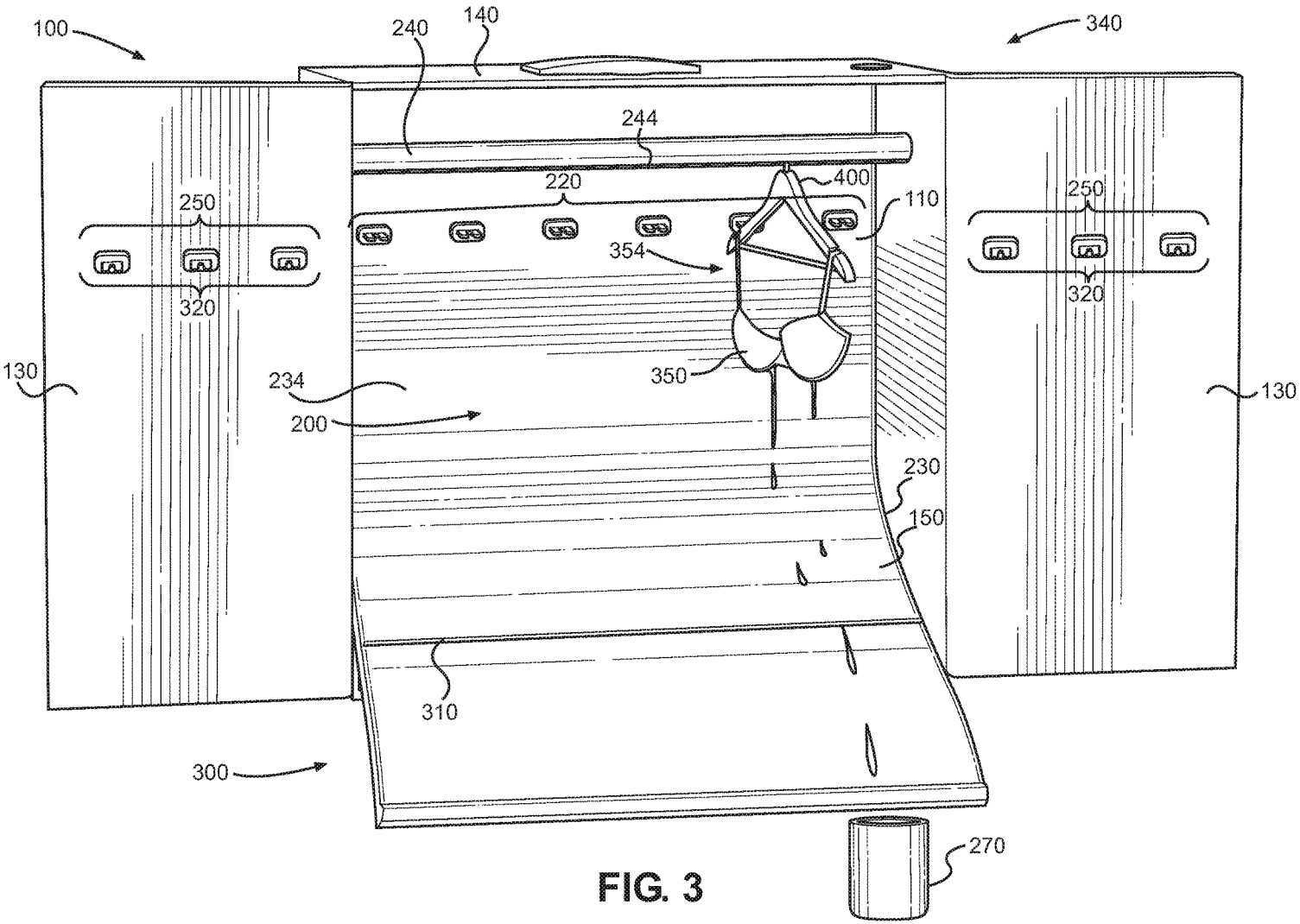
FIG. 3 is a perspective view illustrating the Bra Storage Apparatus in an in-use condition according to an embodiment of the present invention of FIG. 1.
Figure 4:
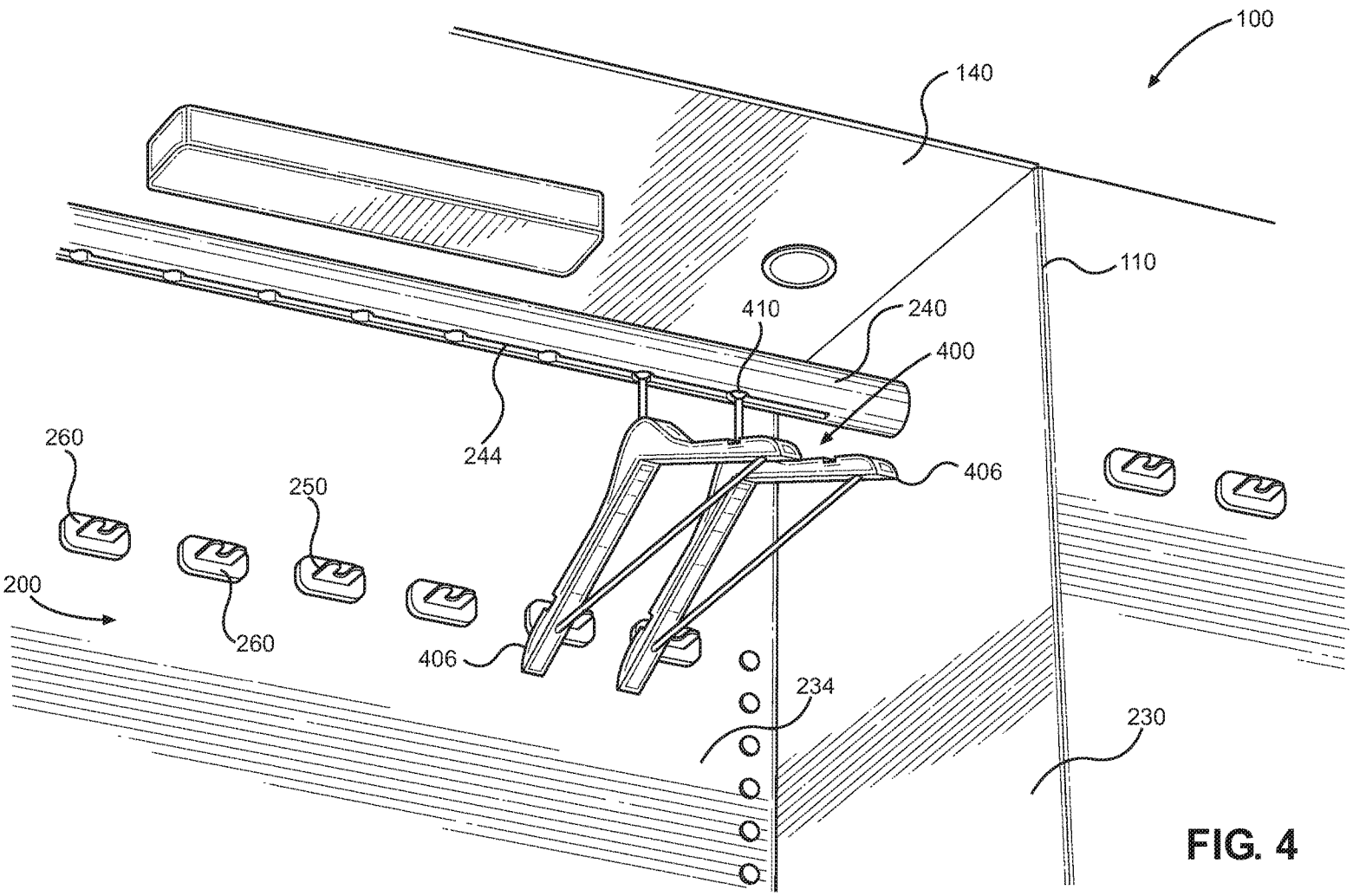
FIG. 4 is a perspective view illustrating a plurality of hanger members of the Bra Storage Apparatus according to an embodiment of the present invention of FIG. 1.

Back panel 200 includes plurality of retainer members 220 attached to an inner surface thereof in a spaced linear configuration, wherein each are adapted to releasably retain an end of hanger member 400 therein. Wherein back panel 200 has six retainer members 222 thereon as shown in FIG. 2; and wherein each of pair of front door members 130 has three retainer members 254 thereon correlating to six retainer members 222 on back panel 200. Wherein back panel 200 has eight retainer members 320 thereon; and wherein each of pair of front door members 130 has four retainer members 330 thereon correlating to eight retainer members 320 on back panel 200 as shown in FIG. 3.

Wherein top panel 140 is attached to a top potion of back panel 200 and extends towards pair of front door members 130. Wherein casing 110 further includes handle member 144 attached to an outer surface of top panel 140. Wherein bottom panel 150 is attached to a bottom potion of back panel 200 and extends towards pair of front door members 130. Wherein casing 110 further includes cup holder 280 attached to an inner surface of bottom panel 150 adjacent back panel 200 and is adapted to releasably store collection cup member 270 therein.

Wherein pair of side panel members 230 are attached to respective side portions of back panel 200 and extend towards pair of front door members 130. Wherein each of pair of front door members 130 are pivotally attached to a respective side panel member 230. Wherein top panel 140, bottom panel 150, pair of side panel members 230, and pair of front door members 130 form interior volume 234 as shown in FIG. 2. Wherein interior volume 234 has a width between 38 and 40 inches, a depth between 12 and 13 inches, and a height between 38 and 40 inches.

Wherein pair of side panel members 230 further comprises hanger rail 240 is connected between respective inside surfaces of pair of side panel members 230, and is adapted to movably retain plurality of hanger members 400 thereon as shown in FIG. 4. Wherein each of plurality of hanger members 400 are adapted to be movably retained upon hanger rail 240 as shown in FIG. 4. Wherein hanger rail 240 includes track portion 244 extending a substantial portion of its length; and plurality of hanger members 400 are each formed having ball top member 410 thereon adapted to slidably engage with track portion 244 of said hanger rail 240. Wherein hanger rail 240 is formed from a material chosen from a list of materials consisting of metal, plastic, and ceramic. Wherein each of plurality of hanger members 400 includes shoulder slot 404 adjacent each end thereof adapted to releasably hold straps 354 of bra 350 thereto as shown in in-use condition 340 of FIG. 3.

Wherein each of plurality of hanger members 400 include opposite ends 406 that are adapted to be releasably retained by respective plurality of retainer members 220 of back panel 200 and plurality of retainer members 250 on pair of front door members 130, such that when pair of front door members 130 are in closed position 134, each of said plurality of hanger members 400 are held in place between back panel 200 and pair of front door members 130 via respective plurality of retainer members 220 of back panel 200 and plurality of retainer members 250 on pair of front door members 130, and when pair of front door members 230 are moved into open position 206 each of plurality of hanger members 400 can be released form respective plurality of retainer members 220 of back panel 200 and plurality of retainer members 250 on pair of front door members 130 and used to retain bra 450 thereon or release bra 450 therefrom.

Wherein water tray member 300 is adapted to be removably placed within interior volume 234 at an angle to bottom panel 150 and is adapted to allow water dripping from wet bras 350 hanging from plurality of hanger members 400 to contact a surface thereof and flow down downwardly upon a surface and outwardly from interior volume 234 as shown in FIG. 3. Wherein water tray member 300 is adapted to be removably stored within interior volume 234, and is adapted to be removed and placed at an angle to bottom panel 150 when in use condition 340 of FIG. 3. Wherein water tray member 300 is adapted to flow water to one corner thereof via groove 310 formed within the surface and leading toward said one corner. Wherein collection cup member 270 is adapted to be placed in proximity to an edge portion of water tray member 300 when water tray member 300 is being used to direct water outwardly from interior volume 234 and is adapted to collect the water therein. Wherein collection cup member 270 is adapted to be placed in proximity to one corner for collecting water running off therefrom when in use.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A bra storage apparatus comprising:

a casing including:

a back panel including:

a plurality of retainer members attached to an inner surface thereof in a spaced linear configuration, wherein each are adapted to releasably retain an end of a hanger member therein;

a pair of front door members, each including:

a plurality of retainer members attached to an inner surface thereof in a spaced linear configuration, wherein each are adapted to releasably retain an end of a hanger member therein;

a top panel;

wherein said top panel is attached to a top potion of said back panel and extends towards said pair of front door members;

a bottom panel;

wherein said bottom panel is attached to a bottom potion of said back panel and extends towards said pair of front door members;

a pair of side panel members;

wherein said pair of side panel members are attached to respective side portions of said back panel and extend towards said pair of front door members; and wherein each of said pair of front door members are pivotally attached to a respective side panel member;

wherein said top panel, said bottom panel, said pair of side panel members, and said pair of front door members form an interior volume;

a hanger rail;

wherein said hanger rail is connected between respective inside surfaces of said pair of side panel members, and is adapted to movably retain a plurality of hanger members thereon;

a plurality of hanger members;

wherein each of said plurality of hanger members are adapted to be movably retained upon said hanger rail; and wherein each of said plurality of hanger members include opposite ends that are adapted to be releasably retained by respective said plurality of retainer members of said back panel and said pair of front door members, such that when said pair of front door members are in a closed position each of said plurality of hanger members are held in place between said back panel and said pair of front door members via respective said plurality of retainer members of said back panel and said pair of front door members, and when said pair of front door members are moved into an open position each of said plurality of hanger members can be released form said respective said plurality of retainer members and used to retain a bra thereon or release a bra therefrom;

a water tray member;

wherein said water tray member is adapted to be removably placed within said interior volume at an angle to said bottom panel and is adapted to allow water dripping from wet bras hanging from said plurality of hanger members to contact a surface thereof and flow down downwardly upon said surface and outwardly from said interior volume; and a collection cup member;

wherein said collection cup member is adapted to be placed in proximity to an edge portion of water tray member when said water tray member is being used to direct water outwardly from said interior volume and is adapted to collect said water therein.

2. The bra storage apparatus of claim 1, wherein said casing further includes a handle member attached to an outer surface of said top panel.

3. The bra storage apparatus of claim 1, wherein said casing further includes a cup holder attached to an inner surface of said bottom panel adjacent said back panel and is adapted to releasably store said collection cup member therein.

4. The bra storage apparatus of claim 1, wherein said hanger rail includes a track portion extending a substantial portion of its length; and said plurality of hanger members are each formed having a ball top member thereon adapted to slidably engage with said track portion of said railing member.

5. The bra storage apparatus of claim 1, wherein said plurality of retainer members are each formed including a pair of spaced, elongated, flexible retention members adapted such that when an end of a hanger is pushed between a pair of said spaced, elongated, flexible retention members said end of said hanger is releasably frictionally held therebetween.

6. The bra storage apparatus of claim 1, wherein said water tray member is adapted to be removably stored within said interior volume, and is adapted to be removed and placed at an angle to said bottom panel when in use.

7. The bra storage apparatus of claim 1, wherein said water tray member is adapted to flow water to one corner thereof via a groove formed within said surface and leading toward said one corner.

8. The bra storage apparatus of claim 7, wherein said collection cup member is adapted to be placed in proximity to said one corner for collecting said water running off therefrom when in use.

9. The bra storage apparatus of claim 1, wherein said pair of front door members are adapted to be releasably locked in a closed position.

10. The bra storage apparatus of claim 1, wherein each of said plurality of hanger members includes a shoulder slot adjacent each end thereof adapted to releasably hold bra straps thereto.

11. The bra storage apparatus of claim 1, wherein said top panel, said bottom panel, said pair of side panel members, and said pair of front door members are formed from molded plastic.

12. The bra storage apparatus of claim 1, wherein said interior volume has a width between 38 and 40 inches, a depth between 12 and 13 inches, and a height between 38 and 40 inches.

13. The bra storage apparatus of claim 1, wherein said back panel has six retainer members thereon; and wherein each of said pair of front door members has three retainer members thereon correlating to the six retainer members on said back panel.

14. The bra storage apparatus of claim 1, wherein said back panel has eight retainer members thereon; and wherein each of said pair of front door members has four retainer members thereon correlating to the eight retainer members on said back panel.

15. The bra storage apparatus of claim 1, wherein said hanger rail is formed from a material chosen from a list of materials consisting of metal, plastic, and ceramic.

16. The bra storage apparatus of claim 1, wherein each of said pair of front door members has a handle member attached to an outer surface thereof.

* * * * *